US009631354B1

(12) United States Patent
Corbin

(10) Patent No.: US 9,631,354 B1
(45) Date of Patent: Apr. 25, 2017

(54) URINAL COUPLING DEVICE, ASSEMBLY AND INSTALLATION METHOD

(71) Applicant: Leo Tony Corbin, Orlando, FL (US)

(72) Inventor: Leo Tony Corbin, Orlando, FL (US)

( * ) Notice: Subject to any disclaimer, the term of this patent is extended or adjusted under 35 U.S.C. 154(b) by 11 days.

(21) Appl. No.: 14/720,158

(22) Filed: May 22, 2015

(51) Int. Cl.
*E03D 11/14* (2006.01)
*B23P 19/08* (2006.01)

(52) U.S. Cl.
CPC ..... *E03D 11/143* (2013.01); *B23P 19/08* (2013.01)

(58) Field of Classification Search
CPC ..... E03D 11/14; E03D 11/1431; E03D 11/16; E03D 11/17
USPC ..... 411/540; 285/70, 71
See application file for complete search history.

(56) References Cited

U.S. PATENT DOCUMENTS 406,272 A * 7/1889 Euvrard ..... F16L 23/032 285/148.26
1,531,253 A * 3/1925 Kaufman ..... E03D 11/14 4/252.2
2,743,460 A * 5/1956 Youngstrom ..... E03D 1/26 248/27.1
3,855,649 A * 12/1974 Morris ..... E03D 11/14 4/252.1
4,185,334 A * 1/1980 Izzi ..... E03D 11/14 285/58
4,355,828 A * 10/1982 Taunton ..... E03D 11/14 285/148.13
4,946,203 A * 8/1990 Giametta ..... E03D 11/13 285/189
6,264,251 B1 * 7/2001 Kunsman ..... F16L 23/032 285/405
2015/0143622 A1 * 5/2015 Lacy ..... E03D 11/143 4/252.2

* cited by examiner

*Primary Examiner* — Janie Loeppke
(74) *Attorney, Agent, or Firm* — Glenn E. Gold, P.A.; Glenn E. Gold

(57) ABSTRACT

A urinal coupling device includes at least one support member and a pair of ears. The support member has a pair of opposite lateral portions and a main portion of an arcuate configuration extending between and rigidly interconnecting the opposite lateral portions. Each of the ears at an inner end portion thereof is attached to one of the opposite lateral portions of the support member such that the ears extend in opposite directions with respect to one another from the support member. Each ear has a slot open at its outer end and closed at its inner end that is configured to receive a urinal mounting bolt. The main portion of the support member has an inner surface configured to interface with an end portion of a tube and an adjacent annular flange of a urinal flange device.

10 Claims, 9 Drawing Sheets

URINAL COUPLING DEVICE, ASSEMBLY AND INSTALLATION METHOD

FIELD OF THE INVENTION

The present invention relates to urinal installation, and more particularly, is concerned with a urinal coupling device and assembly and a urinal coupling assembly installation method.

BACKGROUND OF THE INVENTION

A urinal flange device is commonly used to couple a urinal to a drainpipe that extends through a wall, such as a vertical wall, to receive and carry off effluent to a sewer. An example of a urinal flange device 10 known in the prior art is shown in FIG. 1. The urinal flange device 10 may be made of a suitable plastic, such as corrosion resistant PVC. The urinal flange device 10 includes a cylindrical hub or tube 12, an annular flange 14 integrally attached to, extending about and radially outward from a front end portion 12A of the tube 12, and a pair of wings 16 integrally attached to opposite sides of the annular flange 14 and extending outward in opposite directions therefrom. Each wing 16 has a row of side-by-side apertures 18 formed therethrough. The selected ones of the apertures 18 of the wings 16 receive and generally position urinal mounting bolts (the same as the ones shown in FIG. 6 in association with the urinal coupling assembly of the invention) so that they are deployed to protrude forwardly of the wings 16 and may extend through matching apertures in the urinal 19 in order to mount and fasten the urinal 19 against the wall 20, typically a vertical wall.

A tubular end portion 22 of a drainpipe (not shown) extends through, and at a front edge portion 22A thereof is open and protrudes from, a passage 24 through the wall 20. The drainpipe tubular end portion 22 extends from a back side 20A of the wall 20 to a front side 20B thereof. A tubular main body 12B of the tube 12 of the urinal flange device 10, which extends rearwardly from the annular flange 14 to a rear end portion 12C of the tube 12, inserts through the open front edge portion end 22A of the drainpipe tubular end portion 22 and into the interior 22B thereof where the tube 12 and the drainpipe tubular end portion 22 are glued together. An annular gasket (not shown) is typically deployed between a lower portion of the urinal and a front face 14A of the annular flange 14 on the tube 12 of the urinal flange device 10, about a protruding front edge 12D of the tubular main body 12B so as to provide a seal therebetween.

All too often, such as during installation of a urinal, there occurs an over-tightening of the urinal mounting bolts, and also the possibility a misalignment of the apertures of the urinal with the apertures of the wings 16 of the urinal flange device 10 which receive the urinal mounting bolts. These occurrences may result in the distortion or disfigurement of the urinal flange device wings 16, which over time may lead to their break off so as to adversely affect the mounting of the urinal to the wall, thus requiring repair steps to be taken. The necessary repair steps typically require the removal of the urinal from the wall and portions of the wall cut open to gain access to the broken urinal flange device 10 in order to remove and replace it.

Accordingly, there remains a need in the art for an innovation that will provide a way to prevent the aforementioned occurrences from arising.

SUMMARY OF THE INVENTION

The present invention is an innovation that overcomes the deficiencies of the known art and the problems that remain unsolved by providing a urinal coupling device and assembly and urinal coupling assembly installation method that reduce the possibility of aforementioned undesirable occurrences from arising.

In one aspect of the present invention, a urinal coupling device includes:

- at least one support member having a pair of opposite lateral portions and a main portion of an arcuate configuration extending between and rigidly interconnecting the opposite lateral portions; and
- a pair of ears each at an inner end portion thereof being attached to one of the opposite lateral portions of the support member such that the ears extend in opposite directions with respect to one another from the support member, each of the ears being configured to receive a urinal mounting bolt;
- wherein the main portion of the support member has an inner surface configured to interface with a portion of a tube of a urinal flange device adjacent to annular flange of the urinal flange device.

In another aspect of the present invention, each of the ears is bifurcated so as to form a pair of segments extending one above the other, substantially parallel to one another, and being spaced apart so as to define therebetween a mounting slot having an open outer end and a closed inner end at the inner end portion of the ear and thereby configured to receive insertion of an end of the urinal mounting bolt within the mounting slot via the open outer end thereof. The mounting slots of the ears are spaced apart from one another, aligned with one another, and extend in opposite directions away from one another.

In another aspect of the present invention, the at least one support member is a pair of support members being pivotally connected together at one of the opposite lateral portions of the support members so as to undergo pivoting relative to one another from an opened position, wherein the pair of support members and the ears therewith are angularly displaced apart so as to enable insertion of the support members to a position aligned between the annular flange of the urinal flange device and a wall having a passage receiving therethrough an end portion of an effluent drainpipe, to a closed position, wherein the pair of support members are located adjacent to one another with the ears on each of the opposite lateral portions of the pair of support members disposed adjacent to one another and extending in opposite directions from the annular flange of the urinal flange device such that the mounting slots of the ears are aligned with one another so that the urinal mounting bolts extending from the mounting slots are positioned to couple with a urinal apparatus.

In another aspect of the present invention, the support members and ears thereon have respective pairs of opposite side faces that are substantially co-planar with one another.

In another aspect of the present invention, the main portion of the support member has an annular configuration and extends in a co-planar relationship with the ears being located at the opposite lateral portions of the support member. An inner surface of the main portion of the support member has a cylindrical shape so as to configure the support member to overlie and extend about the portion of the tube of the urinal flange device adjacent to the annular flange of the urinal flange device.

In another aspect of the present invention, the inner surface of the main portion of the support member has a semi-cylindrical shape so as to configure the support member to overlie and interface with the portion of the tube of the urinal flange device adjacent to the annular flange of the urinal flange device.

In another aspect of the present invention, a urinal coupling assembly includes:

a urinal flange device comprising a tube configured to interface with an end portion of an effluent drainpipe extending through a wall, and an annular flange attached about a portion of the tube at a location spaced from the wall; and a urinal coupling device comprising at least one support member having a pair of opposite lateral portions and a main portion of an arcuate configuration extending between and rigidly interconnecting the opposite lateral portions, and a pair of ears each at an inner end portion thereof being attached to one of the opposite lateral portions of the support member such that the ears extend in opposite directions with respect to each other from the support member, each of the ears being configured to receive a urinal mounting bolt, wherein the main portion of the support member has an inner surface configured to interface with a portion of the tube of the urinal flange device adjacent to the annular flange of the urinal flange device.

In another aspect of the present invention, a urinal coupling assembly installation method includes:

inserting a urinal coupling device between a wall and an annular flange on a tube of a urinal flange device disposed adjacent to a passage in the wall;

positioning the urinal coupling device relative to the annular flange of the urinal flange device such that an inner surface of the urinal coupling device interfaces with a portion of the tube of the urinal flange device adjacent to the annular flange of the urinal flange device and such that a pair of ears of the urinal coupling device extend past opposite lateral sides of the annular flange of the urinal flange device in positions to receive urinal mounting bolts; and installing the urinal mounting bolts in the ears of the urinal coupling device so that the urinal mounting bolts extend forwardly from the ears of the urinal coupling device and past the annular flange of the urinal flange device in positions to be coupled with a urinal apparatus.

In another aspect of the present invention, the method also includes:

prior to inserting the urinal coupling device between the wall and the annular flange on the tube of the urinal flange device, pivoting a pair of support members of the urinal coupling device in directions away from one another so as to place the urinal coupling device in an opened position in which the urinal coupling device does not interface with the portion of the tube of the urinal flange device adjacent to the annular flange thereof; and after inserting the urinal coupling device between the wall and the annular flange on the tube of the urinal flange device, pivoting the pair of support members of the urinal coupling device in directions toward one another so as to place the urinal coupling device in a closed position in which the urinal coupling device interfaces with the portion of the tube of the urinal flange device adjacent to the annular flange thereof.

In another aspect of the present invention, the method further includes installing the urinal mounting bolts in the ears of the urinal coupling device by sliding each of the urinal mounting bolts along a slot in each of the ears of the urinal coupling device from an open outer end toward a closed inner end of the slot so as to place the bolts in positions to be coupled with a urinal apparatus.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
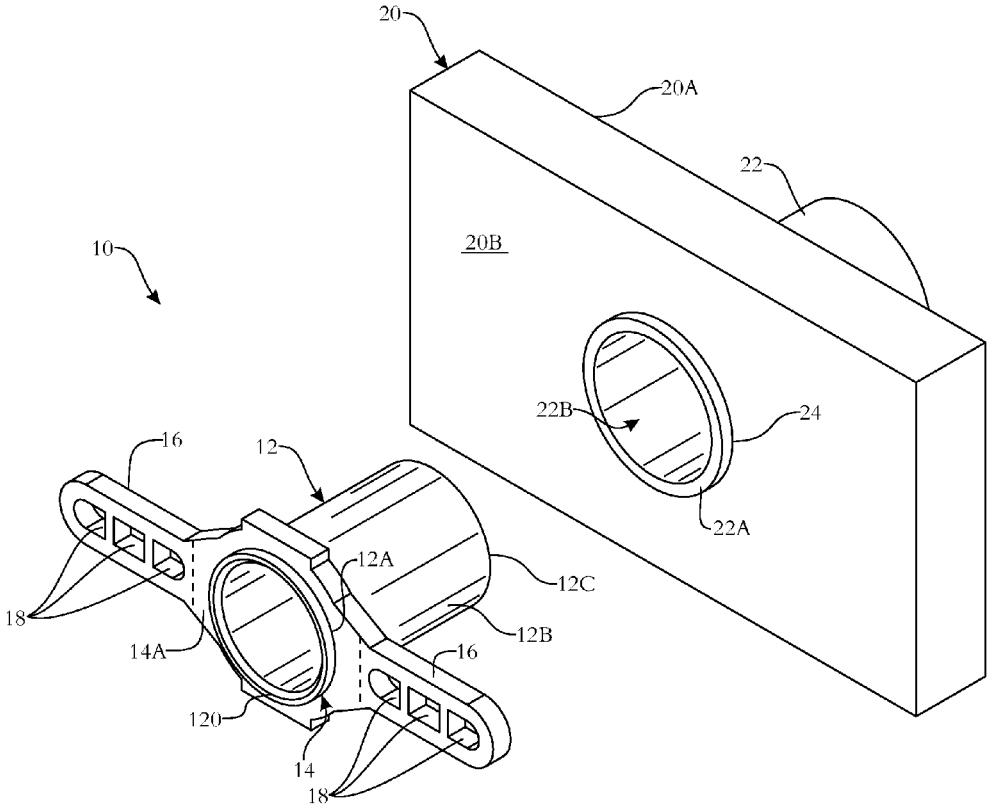
FIG. 1 (PRIOR ART)
FIG. 1 presents an isometric view of a prior art urinal flange device aligned with a tubular end portion of an effluent drainpipe disposed through a passage in a wall.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
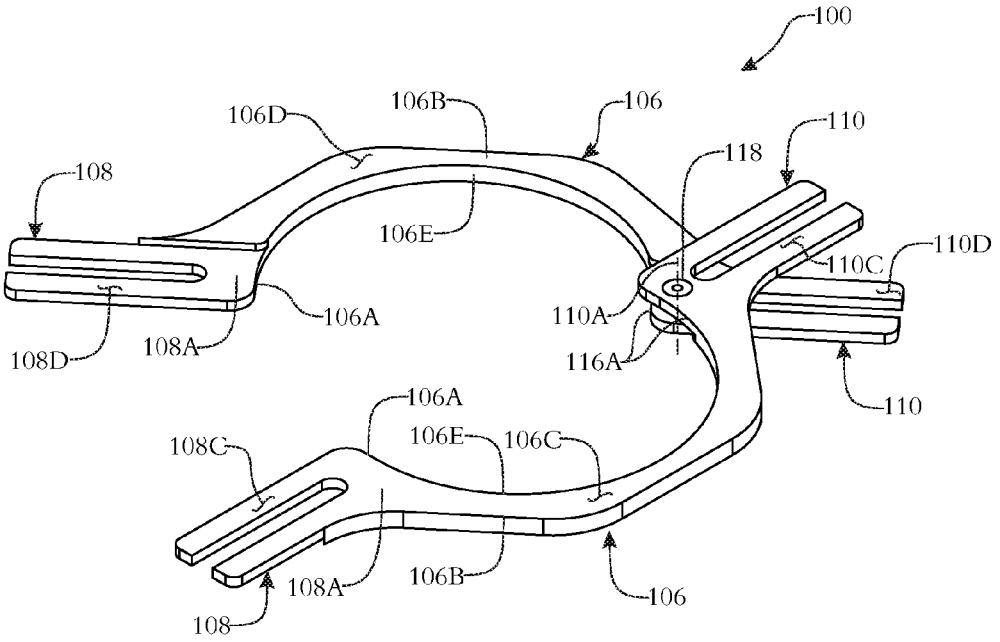
FIG. 2 presents an isometric view of an exemplary embodiment of a urinal coupling device of a urinal coupling assembly in accordance with an aspect of the present invention, the device being shown in an opened position.
Figure 3:
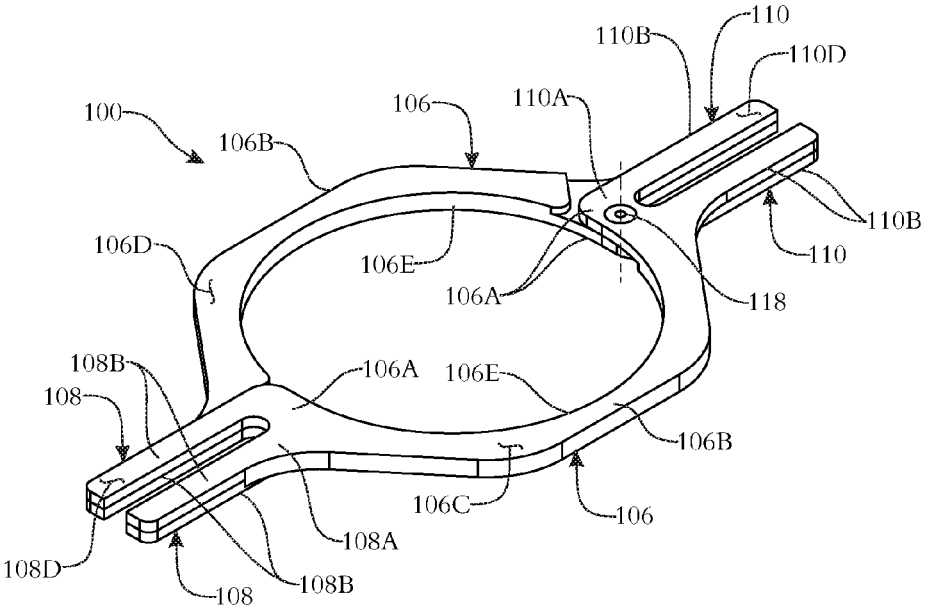
FIG. 3 presents an isometric view of the urinal coupling device originally introduced in FIG. 3, the device being shown in a closed position.
Figure 4:
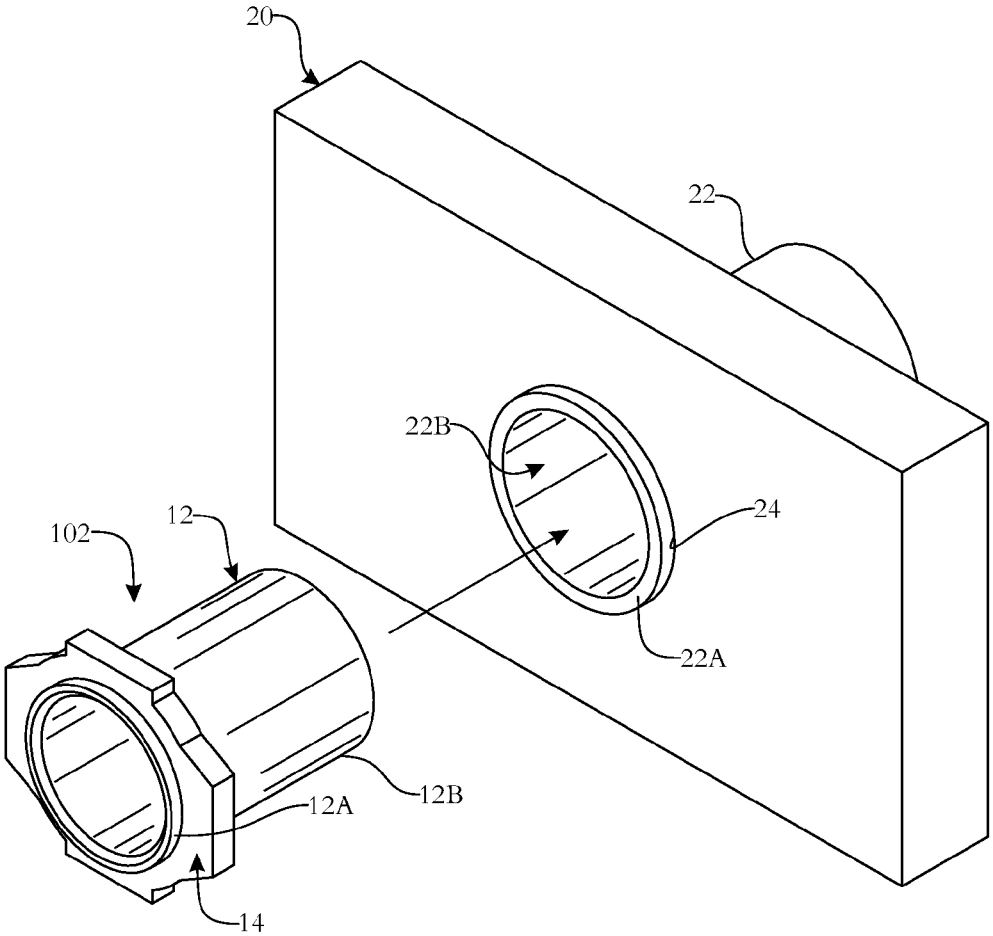
FIG. 4 presents an isometric view of a wingless urinal flange device after its pair of wings have been removed as a step of a urinal coupling assembly installation method in accordance with another aspect of the present invention.
Figure 5:
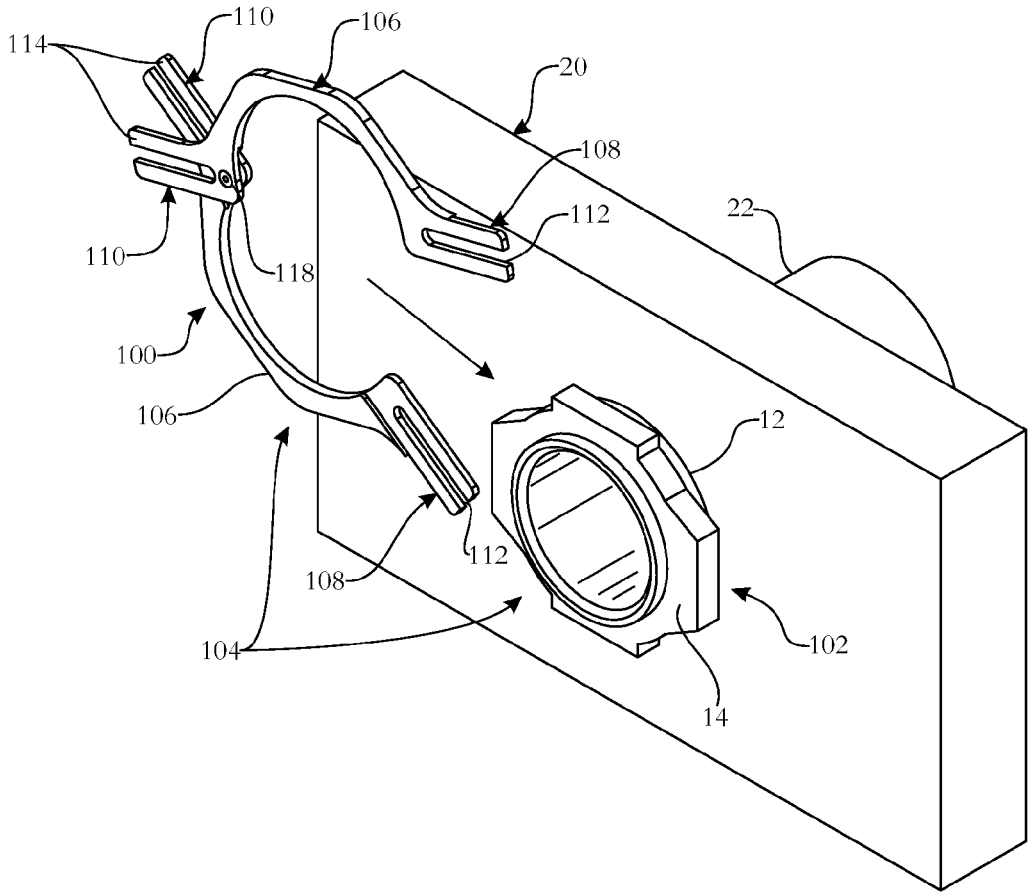
FIG. 5 presents an isometric view of the urinal coupling device in the opened position with the urinal coupling device in the process of being inserted between the wall and the annular flange of the urinal flange device of FIG. 4 as a step of the urinal coupling assembly installation method in accordance with another aspect of the present invention.
Figure 6:
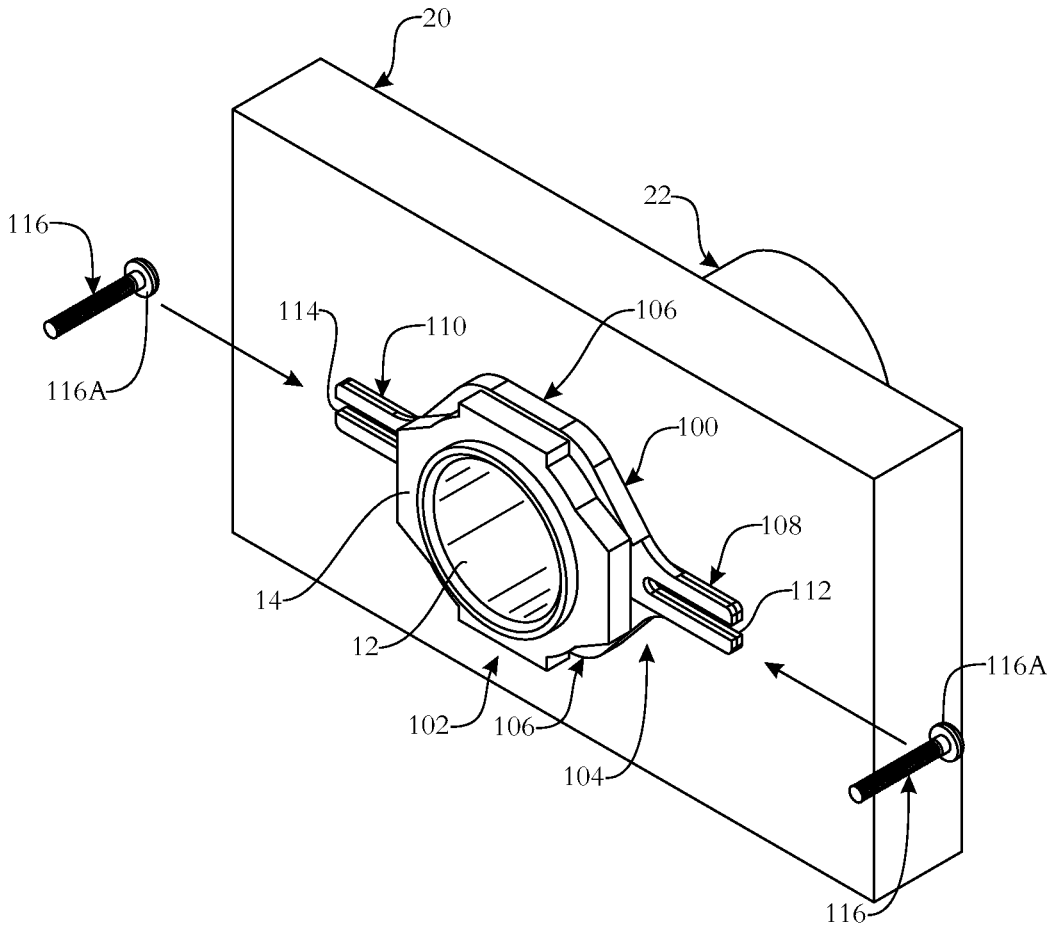
FIG. 6 presents an isometric view of the urinal coupling device in the closed position after the urinal coupling device has been inserted between the wall and the annular flange of the urinal flange device of FIG. 4 and before a pair of urinal mounting bolts have been inserted on a pair of opposite ears of the urinal coupling device as a step of the urinal coupling assembly installation method in accordance with another aspect of the present invention.
Figure 7:
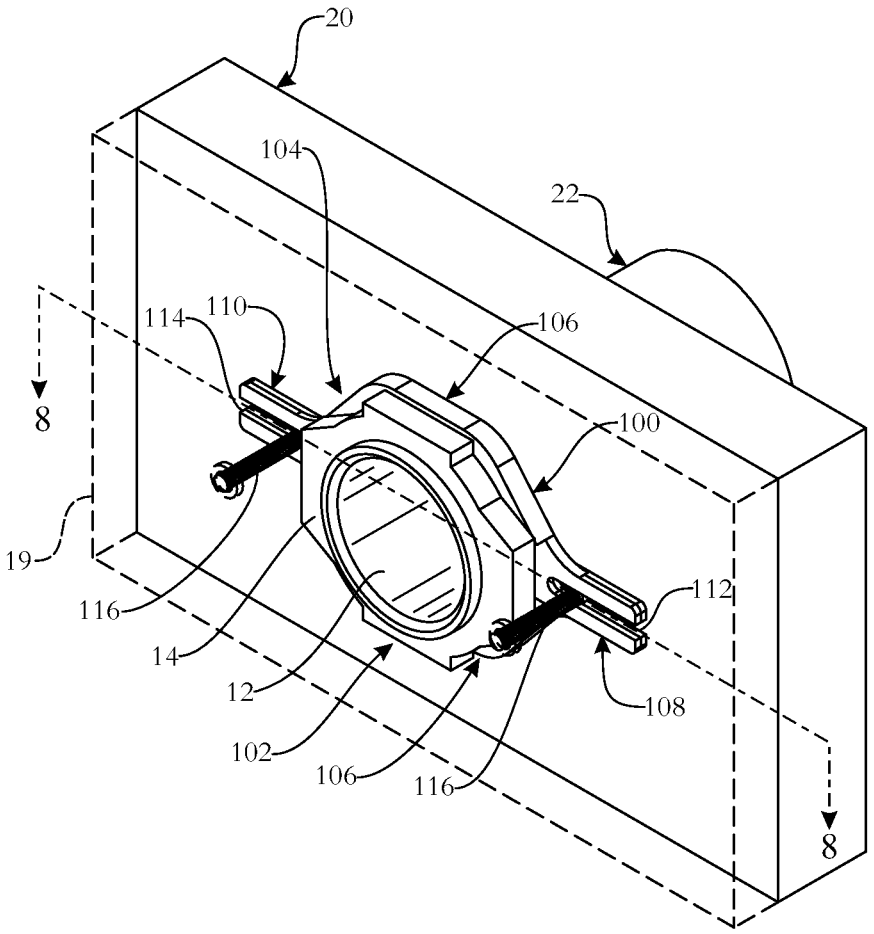
FIG. 7 presents an isometric view of the urinal coupling device in the closed position after the urinal mounting bolts have been inserted on the pair of opposite ears of the urinal coupling device to the position shown in FIG. 6, as a step of the urinal coupling assembly installation method in accordance with another aspect of the present invention.

Referring now to FIGS. 2 and 3, there is illustrated an exemplary embodiment of a urinal coupling device, generally designated 100, in accordance with an aspect of the present invention, for use in performance of a repair service or an original installation. In FIG. 2, the urinal coupling device 100 is shown in an opened position, whereas in FIG. 3 it is shown in a closed position. The urinal coupling device 100 and a wingless urinal flange device 102, as seen in FIG. 4, constitute a urinal coupling assembly, as generally designated 104 in FIGS. 5-8, in accordance with another aspect of the present invention. The wingless urinal flange device 102 is the same as the prior art urinal flange device 10 shown in FIG. 1 except that the device 102 is now wingless. The pair of wings 16 on the prior art urinal flange device 10 shown in FIG. 1 have been removed either during the performance of a repair service call after the wings 16 have failed during the period of use of the device 10 or as a preventive measure prior to the original installation of the device 10, in view that the function of the wings 16 will now be performed by the installation of the urinal coupling device 100 as per the urinal coupling assembly installation method in accordance with another aspect of the present invention, which will be described later below.

As shown in FIGS. 2-8, the urinal coupling device 100 includes a pair of support members 106 and a respective pair of ears 108, 110 on each support member 106. Each support member 106 has a pair of opposite lateral portions 106A and a main portion 106B extending between and rigidly connected with the opposite lateral portions 106A at opposite ends of the main portion. The main portion 106B of each support member 106 has an arched-shaped or arcuate-shaped configuration. The respective pairs of ears 108, 110 at their inner end portions 108A, 110A are integrally attached, or rigidly connected, to the corresponding opposite lateral portions 106A of the respective support members 106 such that the respective pairs of ears 108, 110 on corresponding ones of the support members 106 extend in opposite directions with respect to each other from the support members 106. The respective pairs of ears 108, 110 and the adjacent opposite lateral portions 106A of the support members 106 share opposite side faces 108C, 108D and 110C, 110D and the same thicknesses therebetween. The main portions 106B of the support members 106 have opposite side faces 106C, 106D and the same respective thickness therebetween, which is equal to the combined thicknesses of the respective pairs of ears 108, 110 and adjacent opposite lateral portions 106A.

More particularly, the respective ears 108, 110 are bifurcated so as to form a pair of segments 108B of the ear 108 and a pair of segments 110B of the ear 110. The segments 108B of the pair thereof of the ear 108 are integrally attached to the inner end portion 108A of the ear 108 and extend straight away from the inner end portion 108A, one above the other and substantially parallel to one another. The segments 110B of the pair thereof of the ear 110 are integrally attached to the inner end portion 110A of the ear 110 and extend straight away from the inner end portion 110A, one above the other and substantially parallel to one another. The pairs of segments 108B, 110B of the respective ears 108, 110 are spaced apart so as to define therebetween respective mounting slots 112, 114 of the ears 108, 110. Each slot 112, 114 has an open outer end 112A, 114A and a closed inner end 112B, 114B at the inner end portions 108A, 110A of the respective ears 108, 110. The mounting slots 112, 114 extent substantially straight and as such are thereby configured to receive insertion of respective urinal mounting bolts 116 at least adjacent to their head ends 116A within the mounting slots 112, 114 via the open outer ends 112A, 114A of the slots. Also, the mounting slots 112, 114 of the corresponding ears 108, 110 are spaced apart from one another, aligned with one another, and extend in opposite directions away from one another.

The two support members 106 of the urinal coupling device 100 are pivotally connected together by a pin or rivet 118 extending through matching apertures 120 (best seen in FIG. 8) formed at a single location of the merger of the inner end portions 110A of a corresponding one pair of the ears 110 with one pair of the opposite lateral portions 106A of the support members 106 so as to undergo pivoting, relative to one another solely along a common plane, between an opened position, as seen in FIG. 2, and a closed position, as seen in FIG. 3. In the opened position of FIG. 2 the pair of support members 106 and the ears 108, 110 therewith are angularly displaced sufficiently apart (with the mounting slots 112, 114 of the pairs of ears 108, 110 misaligned with one another) so as to enable insertion of the support members 106 to a position aligned between the annular flange 14 of the wingless urinal flange device 102 and the wall 20 having the passage 20 receiving therethrough the end portion 22 of the effluent drainpipe. In the closed position of FIG. 3, the pair of support members 106 are located near to one another and their respective pairs of ears 108, 110 attached on each of the opposite lateral portions 106B of the support members 106 are juxtaposed, or side-by-side, to one another and extend in opposite directions from the annular flange 14 of the wingless urinal flange device 102 such that the mounting slots 112, 114 of the pairs of ears 108, 110 are aligned with one another so that the urinal mounting bolts 116 extending from the mounting slots 112, 114 are positioned to couple with the urinal 19. Also, one of the pair of opposite side faces 106C on the main portions 106B of the support members 106 and one of the pair of opposite side faces 108C, 110C of the ears 108, 110 (with adjacent opposite lateral portions 106A of the support members 106) are co-planar with one another, while the other of the pair of opposite side faces 106D on the main portions 106B of the support members 106 are slightly offset from the other of the opposite side faces 108D, 110D of the ears 108, 110 (also on the opposite lateral portions 106A of the support members 106). Thus, when the support members 106 and their ears 108, 110 are in the closed position of FIG. 3 the other opposite side faces 108D, 110D of the ears 108, 110 (also on the adjacent opposite lateral portions 106A of the support members 106) will be juxtaposed, or side-by-side, to one another, while the other opposite side faces 106C on the main portions 106B of the support members 106 and the one opposite side faces 108C, 110C of the ears 108, 110 (also on the adjacent opposite lateral portions 106A of the support members 106) are disposed co-planar with one another. Thus, the pair of support members 106 and their respective pairs of ears 108, 110 are substantially identical and also are interchangeable. The offset relationship of the side faces 106D on the main portions 106B of the support members 106 and the side faces 108D, 110D of the ears 108, 110 (also on the adjacent opposite lateral portions 106A of the support members 106) provide recesses that are configured to allow pivoting of the support members 106 relative to one another, about the rivet 118 adjacent the inner end portions 110A of the one opposing pair of ears 110 and along the common plane, between the opened and closed positions of FIGS. 2-3 and a bottoming or abutting of opposing respective ones of the pairs of ears 108, 110 against the corresponding ones of the opposite ends of the main portions 106B of the support members 106 upon reaching the opened and closed position, as seen in FIGS. 2-3.

Each of the main portions 106B of the support members 106 has an inner surface 106E of a substantially semi-cylindrical shape and thus being configured to interface with a correspondingly shaped portion of the tube 12 of the wingless urinal flange device 102 adjacent to the annular flange 14 thereof. The main portions 106B of the support members 106, when taken together, have an annular configuration and extend in a co-planar relationship with the ears 108, 110 being located at the opposite lateral portions 106A of the support members 106. The inner surfaces 106E of the main portions 106B of the support members 106, when taken together, define a cylindrical shape so as to configure the support members 106 to overlie and extend about the portion of the tube 12 of the wingless urinal flange device 102 adjacent to the annular flange 14 of the urinal flange device 102.

It should be understood that the urinal coupling device 100 may perform adequately using only one of the support members 106 (such as the upper one of the support members 106 shown in FIGS. 2 and 3 and thereby omitting the lower one) to overlie the tube 12 and with its ears 108, 110 extending beyond the opposite lateral sides of the wingless urinal flange device 102.

Figure 9:
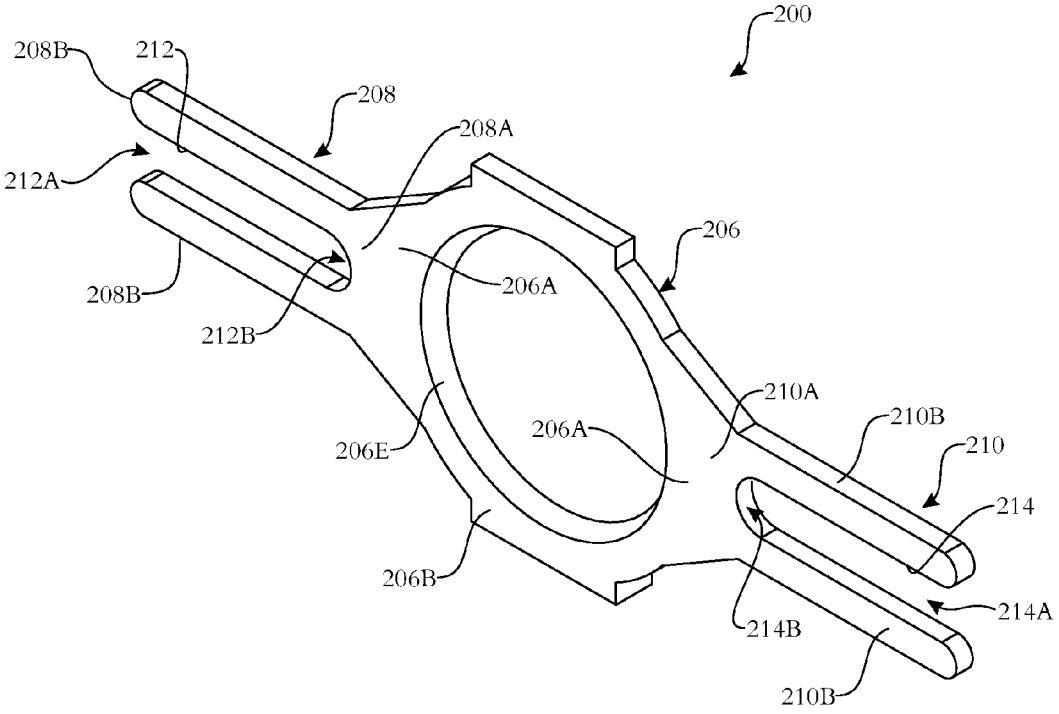
FIG. 9 presents an isometric view of an alternative embodiment of a urinal coupling device in accordance with another aspect of the present invention.
Figure 10:
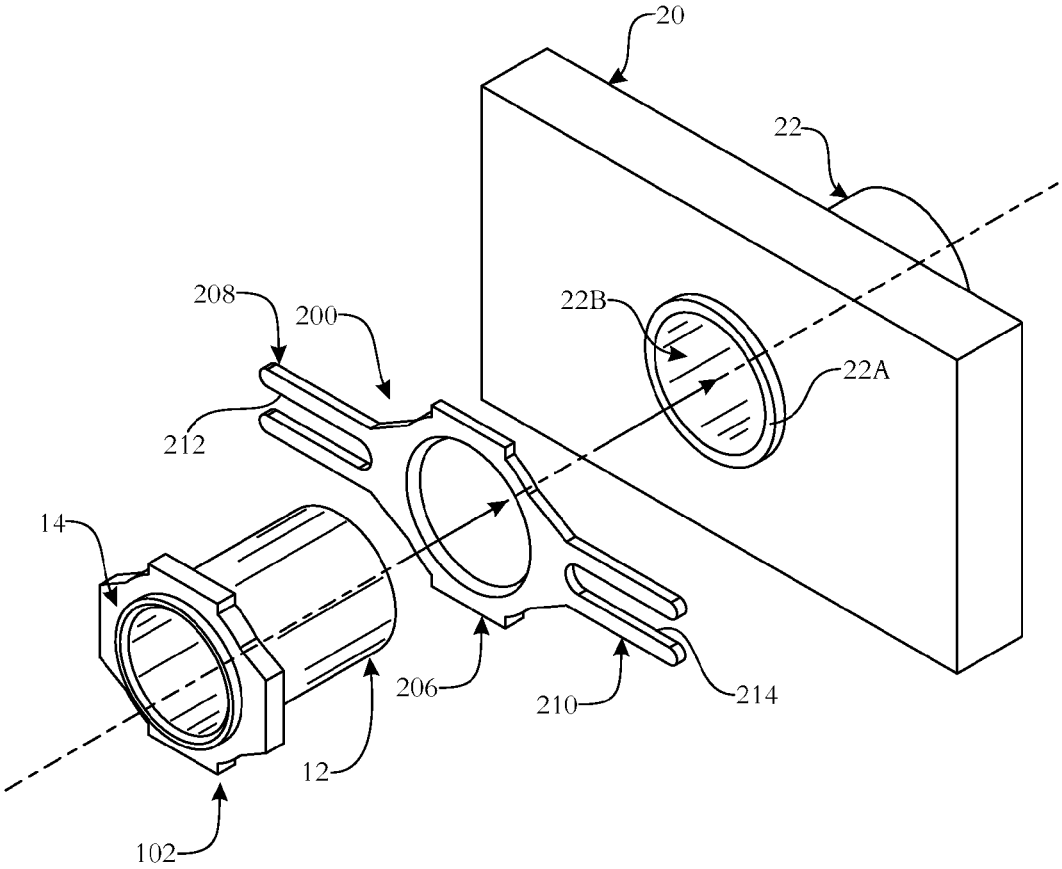
FIG. 10 presents an isometric view of the alternative embodiment of the urinal coupling device originally introduced in FIG. 9, the device being shown disposed between the urinal flange device of FIG. 6 and the wall.

Referring to FIGS. 9 and 10, there is illustrated an alternative embodiment of a urinal coupling device, generally designated 200, in accordance with another aspect of the present invention. Unless otherwise indicated, like features of the urinal coupling devices 100 and 200 are numbered the same except preceded by the numeral '2'. The urinal coupling device 200 is of a one-piece construction in which a main portion 206B of the support member 206 has an annular configuration and extends in a co-planar relationship with the ears 208, 210 being located and attached at the opposite lateral portions 206A of the support member 206. The inner surface 206E of the main portion 206B of the support member 206 has a cylindrical shape so as to configure the support member 206 to overlie and surround or extend about the portion of the tube 12 of the wingless urinal flange device 102 adjacent to the annular flange 14 thereof. The alternative urinal coupling device 200 may be separate from or bonded to the annular flange 14. Also, the two embodiments of the urinal coupling device 100, 200 may be constructed of a suitable metal, such as steel, whereas the wingless urinal flange device 102 may still be made from a suitable plastic.

Figure 8:
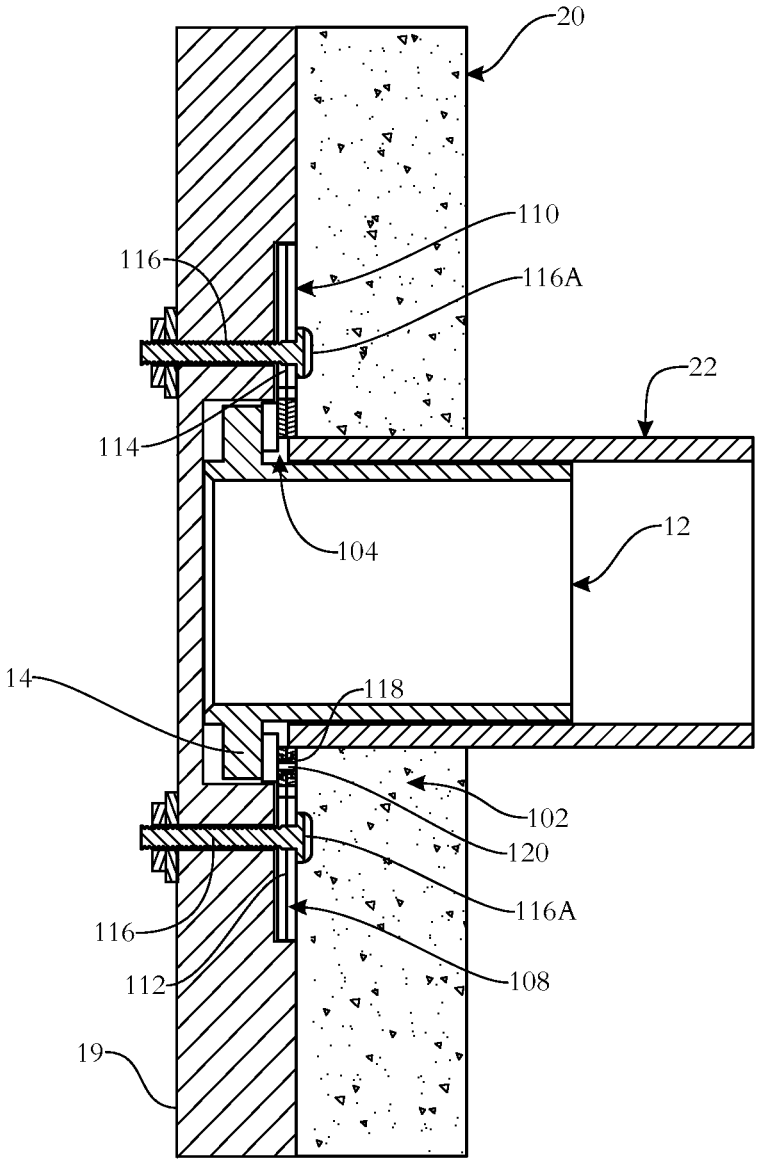
FIG. 8 presents an enlarged cross-sectional view of the installed urinal coupling assembly as seen along line 8-8 of FIG. 7.

It should be understood from the above description that in the case of either the exemplary or the alternative embodiment of the urinal coupling device 100 or 200, their opposite side faces will sit flush against the wall 20 and the annular flange 14 of the wingless urinal flange device 102, as shown in the case of the urinal coupling device 100 in FIG. 8. Consequently, when the urinal 19 is fastened to the flange 14 of the wingless urinal flange device 102 via either of the urinal coupling device 100 or 200, the material of the wall 20 typically gives or subsides sufficiently to allow the head end 116A of each urinal mounting bolt 116 to impress onto the surface of the wall 20.

The exemplary and alternative embodiments of the urinal coupling assembly 104 and 204, as respectively seen in FIGS. 5-8 and FIG. 10, are constituted by either embodiment of the urinal coupling device 100 or 200, as previously described above, together with the wingless urinal flange device 102, as describe previously above. The method of installing the urinal coupling assembly 104 or 204 basically involves the steps of: inserting the tube 12 of a wingless urinal flange device 102 into the tubular end portion 22 of the drainpipe protruding from the passage 24 through the wall 20 until the annular flange 14 on the end 12A of the tube 12 abuts the tubular end portion 22 of the drainpipe protruding from the passage 24 in the wall 20; adhering the tube 12 of the wingless urinal flange device 102 to the tubular end portion 22 of the drainpipe; inserting the urinal coupling device 100 or 200 between the wall 20 and the annular flange 14 on the tube 12 of the wingless urinal flange device 102 being disposed adjacent to the passage 24 in the wall 20; positioning the urinal coupling device 100 or 200 relative to the annular flange 14 of the wingless urinal flange device 102 such that the corresponding inner surface 106E or 206E of the urinal coupling device 100 or 200 interfaces with a portion of the tube 12 of the wingless urinal flange device 102 adjacent to the annular flange 14 thereof such that the pair of ears 108, 110 or 208, 210 of the urinal coupling device 100 or 200 extend past opposite lateral sides of the annular flange 14 of the wingless urinal flange device 102 in positions to receive urinal mounting bolts; and installing the urinal mounting bolts in the ears 108, 110 or 208, 210 of the urinal coupling device 100 or 200 so that the urinal mounting bolts 116 extend forwardly from the ears 108, 110 or 208, 210 and past the annular flange 14 of the wingless urinal flange device 102 in positions to be coupled with the urinal 19.

Also, with respect to only the exemplary embodiment, prior to inserting the urinal coupling device 100 between the wall 20 and the annular flange 14 on the tube 12 of the wingless urinal flange device 102, the support members 106 of the urinal coupling device 100 are pivotally moved in directions away from one another so as to place the urinal coupling device 100 in the opened position in which the urinal coupling device 100 does not interface with the portion of the tube 12 of the wingless urinal flange device 102 adjacent to the annular flange 14 thereof. Further, with respect to only the exemplary embodiment, after inserting the urinal coupling device 100 between the wall 20 and the annular flange 14 on the tube 12 of the wingless urinal flange device 102, the support members 106 of the urinal coupling device 100 are pivotally moved in directions toward one another so as to place the urinal coupling device 100 in the closed position in which the urinal coupling device 100 interfaces with the portion of the tube 12 of the wingless urinal flange device 102 adjacent to the annular flange 14 thereof. With respect to both the exemplary and alternative embodiments, the installing the urinal mounting bolts 116 in the ears 108, 110 or 208, 210 of the urinal coupling device 100 or 200 involves sliding each of the urinal mounting bolts 116 along the slot 112, 114 or 212, 214 in the respective the ears 108, 110 or 208, 210 of the urinal coupling device 100 or 200 from the open outer end 112A, 114A or 212A, 214A toward the closed inner end 112B, 114B or 212B, 214B of the slot 112, 114 or 212, 214 to place the bolts 116 in positions to be coupled with the urinal 19.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A urinal coupling device, comprising:

a pair of support members, each support member comprising a pair of opposite lateral portions, each opposite lateral portion having opposite side faces and a thickness therebetween, and a main portion having opposite ends and being of an arcuate configuration, said main portion extending between and rigidly connected with said opposite lateral portions at said opposite ends of said main portion, said main portion also having opposite side faces and being of a thickness therebetween equal to combined thicknesses of said opposite lateral portions; and a pair of ears on said each support member proximate said opposite ends of said main portion of said each support member, each ear of said pair being rigidly connected with one of said opposite lateral portions of said each support member such that said ears extend in opposite directions with respect to one another from said opposite lateral portions of said each support member, said each ear also having a pair of opposite side faces and being of a thickness the same as the thickness of the rigidly connected one of said opposite lateral portions of said support member such that said respective opposite side faces of said ears and said opposite lateral portions of said support member are substantially co-planar with one another and co-planar with one of said opposite side faces of said main portion of said support member and recessed from the other of said opposite side faces of said main portion of said support member;

wherein said support members are pivotally interconnected together at a single location on an adjacent one pair of said opposite lateral portions of said support members at a corresponding one of said opposite ends of said main portions of said support members so as to undergo pivoting, relative to one another solely along a common plane, about said single location between an opened position, in which said support members are angularly displaced apart, and a closed position, in which corresponding ones of said pairs of opposite lateral portions of said support members with said rigidly connected pairs of said ears at said corresponding opposite ends of said main portions of said support members are engaged with one another such that said corresponding ones of said pairs of opposite lateral portions with said rigidly connected pairs of said ears are located side-by-side one another and such that said pairs of ears define a pair of urinal mounting bolt slots;

also wherein said respective co-planar and recessed relationships of said opposite side faces of said opposite lateral portions of said support members, and said rigidly connected adjacent pairs of ears, with said opposite side faces of said main portions of said support members enable abutting of respective adjacent ones of said opposing pair of said ears against corresponding ones of said ends of said main portions of said support members at said opened and closed positions of said support members and such that said pairs of ears define said urinal mounting bolt slots upon reaching said closed position.

2. The device of claim 1 wherein each of said ears is bifurcated so as to form a pair of segments disposed one above the other and extending substantially parallel to one another, said segments of each pair of said ears being spaced apart so as to define therebetween said urinal mounting bolt slot having a closed inner end proximate said opposite lateral portions at said opposite ends of said main portions of said support members and an open outer end to receive insertion of a urinal mounting bolt within said urinal mounting bolt slot.

3. The device of claim 2 wherein said urinal mounting bolt slots of said pairs of ears are spaced apart from one another, aligned with one another, and extend in opposite directions away from one another.

4. The device of claim 1 wherein said each of said support members has an inner surface of a semi-cylindrical shape.

5. A urinal coupling assembly, comprising:

a wingless urinal flange device comprising an elongated tube, and an annular flange attached about an end portion of said elongated tube; and a urinal coupling device comprising a pair of support members, each support member comprising a pair of opposite lateral portions, each opposite lateral portion having opposite side faces and a thickness therebetween, and a main portion having opposite ends and being of an arcuate configuration, said main portion extending between and rigidly connected with said opposite lateral portions at said opposite ends of said main portion, said main portion also having opposite side faces and being of a thickness therebetween equal to combined thicknesses of said opposite lateral portions, and a pair of ears on said each support member proximate said opposite ends of said main portion of said each support member, each ear of said pair being rigidly connected with one of said opposite lateral portions of said each support member such that said ears extend in opposite directions with respect to one another from said opposite lateral portions of said each support member, said each ears also having a pair of opposite side faces and being of a thickness the same as the thickness of the rigidly connected one of said opposite lateral portions of said support member such that corresponding ones of said respective opposite side faces of said ears and of said opposite lateral portions of said support member are substantially co-planar with one another and co-planar with one of said opposite side faces of said main portion of said support member and recessed from the other of said opposite side faces of said main portion of said support member;

wherein said support members are pivotally interconnected together at a single location on an adjacent one pair of said opposite lateral portions of said support members at a corresponding one of said opposite ends of said main portions of said support members so as to undergo pivoting, relative to one another solely along a common plane, about said single location between an opened position, in which said support members are angularly displaced apart, and a closed position, in which corresponding ones of said pairs of opposite lateral portions of said support members with said rigidly connected pairs of said ears at said corresponding opposite ends of said main portions of said support members are engaged with one another such that said corresponding ones of said pairs of opposite lateral portions with said rigidly connected pairs of said ears are located side-by-side one another and such that said pairs of ears define a pair of urinal mounting bolt slots;

also wherein said respective co-planar and recessed relationships of said opposite side faces of said opposite lateral portions of said support members, and said rigidly connected adjacent pairs of ears, with said opposite side faces of said main portions of said support members enable abutting of respective adjacent ones of said opposing pair of said ears against corresponding ones of said ends of said main portions of said support members at said opened and closed positions of said support members and such that said pairs of ears define said urinal mounting bolt slots upon reaching said closed position.

6. The assembly of claim 5 wherein each of said ears is bifurcated so as to form a pair of segments disposed one above the other and extending substantially parallel to one another, said segments of each pair of said ears being spaced apart so as to define therebetween said urinal mounting bolt slot having proximate said opposite lateral portions at said opposite ends of said main portions of said support members and an open outer end to receive insertion of a urinal mounting bolt within said urinal mounting bolt slot.

7. The assembly of claim 6 wherein said urinal mounting bolt slots of said pairs of ears are spaced apart from one another, aligned with one another, and extend in opposite directions away from one another.

8. The assembly of claim 5 wherein said each of aid support members has an inner surface of a semi-cylindrical shape.

9. A urinal coupling assembly installation method, comprising:

inserting a tube of a wingless urinal flange device into a tubular end portion of a drainpipe protruding from a passage through a wall until an annular flange on an end of the tube abuts the tubular end portion of the drainpipe protruding from the passage in the wall;

adhering the tube of the wingless urinal flange device to the tubular end portion of the drainpipe;

pivoting a pair of support members of a urinal coupling device in opposite directions away from one another about a single pivotal connection, and solely along a common plane, between the support members at one pair of adjacent ones of opposite lateral portions of the support members and a pair of ears adjacent thereto such that the ears of the pair thereof are misaligned with one another and the urinal coupling device is placed in an opened position in which the other pair of adjacent ones of the opposite lateral portions of the support members and a pair of ears adjacent thereto will not interface with a portion of the tube of the wingless urinal flange device adjacent to the annular flange thereon;

with the pair of support members of the urinal coupling device in the opened position, inserting the urinal coupling device between the wall and the annular flange on the tube of the wingless urinal flange device disposed adjacent to the tubular end portion of the drainpipe protruding from the passage in the wall;

pivoting the pair of support members, with the pairs of ears thereon, of the urinal coupling device in opposite directions, solely along a plane and away from the opened position, toward one another about the single pivotal connection so as to place the urinal coupling device in a closed position in which the pair of support members interfaces with the portion of the tube of the wingless urinal flange device adjacent to the annular flange thereon and the pairs of ears on the support members are brought into alignment with one another so as to define respective urinal mounting bolt slots in the pairs of ears upon reaching the closed position;

positioning the urinal coupling device relative to the annular flange of the wingless urinal flange device such that an inner surface of the support members of the urinal coupling device interfaces with a portion of the tube of the wingless urinal flange device adjacent to the annular flange of the wingless urinal flange device and such that the pairs of aligned ears of the urinal coupling device extend past opposite lateral sides of the annular flange of the wingless urinal flange device in positions to receive urinal mounting bolts in the respective urinal mounting bolt slots extending in opposite directions from the tube and annular flange of the wingless urinal flange device; and installing the urinal mounting bolts in the respective urinal mounting bolt slots of the pairs of ears of the urinal coupling device so that the urinal mounting bolts extend forwardly from the pairs of ears of the urinal coupling device and past the annular flange of the wingless urinal flange device in positions to be coupled with a urinal.

10. The method of claim 9 wherein said installing the urinal mounting bolts in the respective urinal mounting bolt slots of the pairs of ears of the urinal coupling device is accomplished by sliding each of the urinal mounting bolts along one of the slots in each of the pairs of ears of the urinal coupling device from an open outer end toward a closed inner end of the slot so as to place the bolts in positions to be coupled with the urinal.

* * * * *